US010545440B2

(12) United States Patent
Ikegami et al.

(10) Patent No.: US 10,545,440 B2
(45) Date of Patent: Jan. 28, 2020

(54) PRESSURE ROLLER, IMAGE HEATING DEVICE, AND IMAGE FORMING APPARATUS

(71) Applicant: CANON KABUSHIKI KAISHA, Tokyo (JP)

(72) Inventors: Shoichiro Ikegami, Yokohama (JP); Naofumi Murata, Tokyo (JP); Yutaka Arai, Kawasaki (JP); Jun Miura, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/038,441

(22) Filed: Jul. 18, 2018

(65) Prior Publication Data

US 2019/0033762 A1 Jan. 31, 2019

(30) Foreign Application Priority Data

Jul. 25, 2017 (JP) ..... 2017-143886

(51) Int. Cl.
*G03G 15/20* (2006.01)
*G03G 15/08* (2006.01)
*G03G 15/16* (2006.01)

(52) U.S. Cl.
CPC ..... *G03G 15/2064* (2013.01); *G03G 15/0808* (2013.01); *G03G 15/16* (2013.01); *G03G 15/2028* (2013.01)

(58) Field of Classification Search
CPC ..... G03G 15/2064
USPC ..... 399/328
See application file for complete search history.

(56) References Cited

U.S. PATENT DOCUMENTS 5,525,775 A 6/1996 Setoriyama et al.
6,002,910 A * 12/1999 Eddy ..... G03G 15/2057 219/216
6,007,657 A * 12/1999 Eddy ..... G03G 15/2057 156/184
6,459,878 B1 10/2002 Tomoyuki et al.
9,134,664 B2 9/2015 Miura et al.
9,152,110 B2 10/2015 Miura et al.
9,268,273 B2 2/2016 Miyahara et al.
9,304,461 B2 4/2016 Miura et al.
9,335,690 B2 5/2016 Asaka et al.
9,348,282 B2 5/2016 Tamura et al.
9,348,283 B2 5/2016 Takada et al.
(Continued)

FOREIGN PATENT DOCUMENTS

JP 4-44075 A 2/1992
JP 9-114281 A 5/1997
(Continued)

OTHER PUBLICATIONS

Murata et al., U.S. Appl. No. 16/014,256, filed Jun. 21, 2018.

*Primary Examiner* — Quana Grainger
(74) *Attorney, Agent, or Firm* — Venable LLP

(57) ABSTRACT

Provided is a pressure roller for an image heating device that forms a nip part together with a heating member, the pressure roller including at least a mandrel, a first elastic layer, and a second elastic layer provided between the mandrel and the first elastic layer, wherein the first elastic layer has open-cell voids, is made of rubber, and has a thickness of at least 50 μm and less than 500 μm, and the second elastic layer is made of solid rubber.

15 Claims, 7 Drawing Sheets

(56) References Cited

U.S. PATENT DOCUMENTS

| | | | | |
|---|---|---|---|---|
| 9,367,009 | B2 | 6/2016 | Akiyama et al. | |
| 9,701,053 | B2 | 7/2017 | Asaka et al. | |
| 9,817,348 | B2 | 11/2017 | Murata et al. | |
| 2011/0091252 | A1* | 4/2011 | Sekihara | G03G 15/206 399/333 |
| 2017/0097594 | A1* | 4/2017 | Ishikawa | B29C 35/02 |
| 2018/0210354 | A1 | 7/2018 | Asaka | |
| 2018/0373183 | A1* | 12/2018 | Murata | G03G 15/206 |

FOREIGN PATENT DOCUMENTS

| | | | |
|---|---|---|---|
| JP | 2001-32825 | A | 2/2001 |
| JP | 2002-148988 | A | 5/2002 |
| JP | 2012-163812 | A | 8/2012 |
| JP | 2015-114368 | A | 6/2015 |

* cited by examiner

PERIPHERAL SECTION

LONGITUDINAL SECTION

PRESSURE ROLLER, IMAGE HEATING DEVICE, AND IMAGE FORMING APPARATUS

BACKGROUND OF THE INVENTION

Field of the Invention

The present invention relates to a pressure roller for use in an image heating device for an image forming apparatus such as a copier, a printer, and a facsimile which operates according to a recording method such as an electrophotographic system and an electrostatic recording method, and relates to an image heating device, and an image forming apparatus.

Description of the Related Art

As an image heating device for an image forming apparatus of this kind, a conventional device according to a film heating method as disclosed, for example, in Japanese Patent Application Publication No. H04-044075 has been known. More specifically, the device includes a cylindrical film and a heater provided in contact with the inner surface of the film to sandwich the film between a pressure roller and the heater, and the pressure roller is used to press the film against the heater, so that a nip part is formed. While a recording material bearing a toner image is transported by the nip part, the toner image is heated.

The film heating type image heating device uses a film with a smaller heat capacity than a heat roller for a heat roller type heating device, and rising time required until a prescribed temperature is attained can be reduced. Since the rising time is reduced, the film does not have to be kept warm during a stand-by period, which allows power consumption to be reduced as much as possible.

In recent years, in pursuit of further rising time reduction and power saving, there has been a proposed configuration with reduced heat conduction/reduced heat capacity produced by providing a pressure roller with an elastic layer including dispersed voids formed by resin micro balloons (Japanese Patent Application Publication No. 2002-148988).

In the configuration, since thermal diffusion from the surface to the inside of the pressure roller can be prevented, the temperature of a heating rotary unit can quickly be raised while the temperature of the surface of the pressure roller can quickly be raised, so that the rising time can be even more reduced.

However, when the elastic layer of the pressure roller in the image heating device has reduced heat conduction/reduced heat capacity, thermal diffusion into the pressure roller is prevented. Therefore, when sheets of a recording material (small-sized sheets of paper) having a shorter longitudinal size than that of the heater are successively passed and heated for fixation, the temperature at a non-paper-passing region (non-paper-passing part) for a small-sized sheet may be raised excessively (temperature rise at the non-paper feeding part) in the longitudinal direction of the nip part.

In order to achieve both rising time reduction and prevention of the temperature rise at the non-paper passing part to solve the above problem, Japanese Patent Application Publication No. 2012-163812 discloses a pressure roller including a first elastic layer with low thermal conductivity provided on an outer surface side, and a second elastic layer of rubber with high thermal conductivity provided on the inside of the outer surface side elastic layer. The first elastic layer is made of balloon rubber including dispersed voids formed by resin micro balloons.

SUMMARY OF THE INVENTION

However, in recent years, there has been a demand for an image forming apparatus such as a copier/printer with even shorter rising time, and heat is supplied from a heater to the surface side of a pressure roller at the rising time in a shorter period of time to cope with increased printing speed. In this way, heat is transferred actively in a shallower region in the vicinity of the surface layer than in the conventional manner and in order to achieve both quick rising and prevention of temperature rise at a non-paper-passing part, an insulating layer with low thermal conductivity must be formed on the surface layer of the pressure roller in reduced thickness and with higher precision than those in the conventional structure.

In the pressure roller disclosed in Japanese Patent Application Publication No. 2012-163812, the first elastic layer on the outer surface side is made of non-open cell foam balloon rubber. Therefore, as such a surface elastic layer has become thinner, pressure unevenness has been generated or more often encountered, which results in gloss unevenness emerging in an output image.

With the foregoing in view, an object of the present invention is to provide a pressure roller, an image heating device, and an image forming apparatus capable of outputting an excellent image with reduced gloss unevenness while achieving both quick rising and prevention of temperature rise at a non-paper-passing part.

In order to achieve the object, the pressure roller according to the present invention includes:

a mandrel;

a first elastic layer; and a second elastic layer provided between the mandrel and the first elastic layer, wherein the pressure roller is used in an image heating device which heats a toner image borne on a recording material, wherein the first elastic layer is made of rubber having open-cell voids, and the second elastic layer is made of solid rubber, and the first elastic layer has a thickness of at least 50 μm and not more than 500 μm.

Further, the image heating device according to the present invention includes:

the pressure roller described above; and a heating rotary member which forms a nip part together with the pressure roller, wherein a toner image borne on a recording material is heated while the recording material is transported by the nip part.

Furthermore, the image forming apparatus according to the present invention includes:

an image forming unit which forms a toner image on a recording material; and the image heating device described above.

According to the present invention, both quick rising and prevention of temperature rise at a non-paper-passing part can be achieved, while an excellent image with reduced gloss unevenness can be output.

Further features of the present invention will become apparent from the following description of exemplary embodiments with reference to the attached drawings.

DESCRIPTION OF THE EMBODIMENTS

The present invention will be described in detail with reference to illustrated examples. Note however that the dimensions, materials, and shapes of elements and the relative positions thereof in the following description of the embodiment are not indented to limit the scope of the invention.

A feature of the present invention relates to a pressure roller for use in an image heating device, the elastic member of the pressure roller includes a first elastic layer as an insulating layer and a second elastic layer as a thermal diffusion layer, and the first elastic layer is formed as a thin layer having open-cell foam. In this way, the rising time can be reduced, the temperature rise at the non-paper-passing part when small-size sheets are fed can be suppressed at the same time, and undesirable gloss unevenness is reduced.

Example 1

To start with, a general structure of an image forming apparatus in which an image heating device according to the invention is used will be described, and then the image heating device and a pressure roller according to the present invention will be described in detail.

Structure of Image Forming Apparatus

Figure 2A:
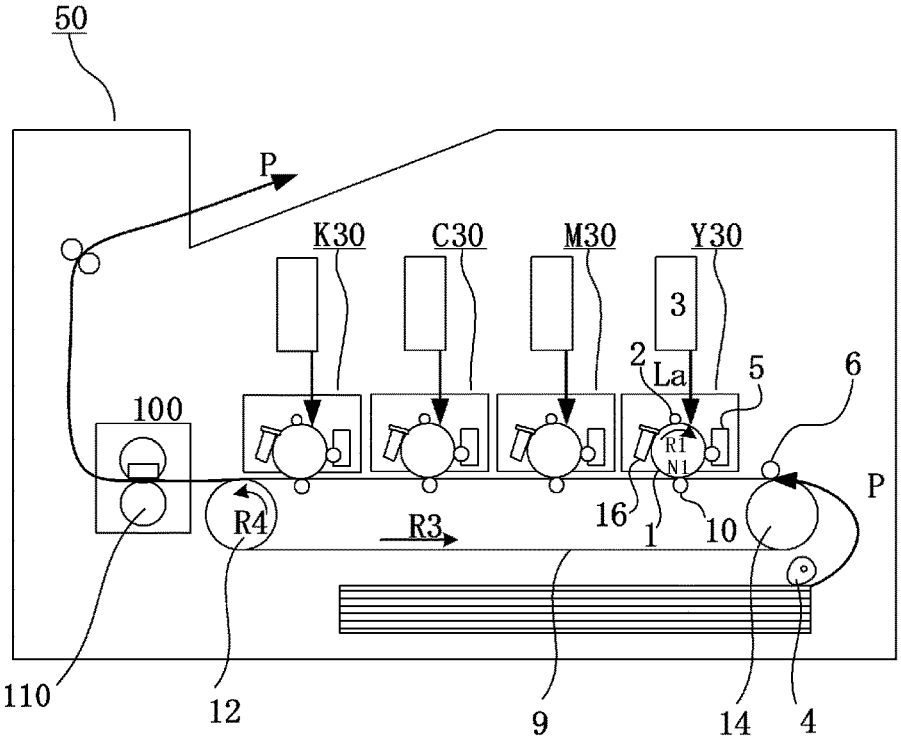
FIG. 2A is a schematic view of an image forming apparatus in which the pressure roller shown in FIGS. 1A and 1B is used.

FIG. 2A is a schematic view of an exemplary image forming apparatus to which the present invention is applied.

In the image forming apparatus 50, four image forming units Y30, M30, C30, and K30 for forming toner images in four colors, yellow Y, magenta M, cyan C, and black K are arranged in series in the transport direction along a transport belt 9 which transports a recording material. The toner images in the four colors, yellow, magenta, cyan, and black are sequentially transferred onto the recording material P bore on the transport belt 9, so that a single image is formed. The image forming units Y30, M30, C30, and K30 are adapted to form images by an electrostatic photography process and have the same structure. Now, the image forming unit Y30 will be described by way of illustration. The unit includes a charging device 2, a developing device 5, a transfer roller 10, and a drum cleaner 16 in this order in the rotation direction (indicated by the arrow R1) at the circumferential surface of a photoreceptor drum 1 as an image bearing member. A window for irradiating the photoreceptor drum 1 with a laser beam La from an exposure device 3 is provided between the charging device 2 and the developing device 5. The transfer roller 10 is opposed to the photoreceptor drum 1 through the transport belt 9.

In the image forming process, the photoreceptor drum 1 has its surface charged to negative polarity by the charging device 2. Then, the charged photoreceptor drum 1 forms an electrostatic latent image on the surface by the laser beam La from the exposure device 3 (as the exposed part has a raised surface potential). A toner in each color in this example is charged to negative polarity, and the developing device 5 having a yellow toner as the first color toner allows the negative toner to stick only to the electrostatic latent image part on the photoreceptor drum 1 and a yellow toner image is formed on the photoreceptor drum 1.

Meanwhile, the transport belt 9 is supported by two support shafts (a driving roller 12 and a tension roller 14) and is rotated in the direction of the arrow R3 in FIG. 2A by the driving roller 12 which rotates in the direction of the arrow R4. The recording material P fed by a feed roller 4 is charged by a suction roller 6 provided with a bias of positive polarity, then electrostatically sucked onto the transport belt 9 and transported. When the recording material P is transported to a transfer nip N1, a transfer bias of positive polarity opposite to the polarity of the toner is applied to the transfer roller 10 which rotates together with the transport belt 9 from a power supply which is not shown, and the yellow toner image on the photoreceptor drum 1 is transferred on the recording material P at the transfer nip N1. The photoreceptor drum 1 after the transfer has toner remaining after the transfer on its surface removed by the drum cleaner 16 having an elastic blade.

The series of steps in the image forming process including charging, exposure, development, transfer, and cleaning described above is sequentially carried out for the image forming unit M30 for the second color (magenta), the image forming unit C30 for the third color (cyan), and the image forming unit K30 for the fourth color (black), and a four-color toner image is formed on the recording material P on the transport belt 9. The recording material P bearing the four-color toner image is transported to the image heating device 100 and the toner image on the surface is subjected to heating fixation.

General Structure of Image Heating Device

Now, the image heating device 100 according Example 1 will be described.

Figure 2B:
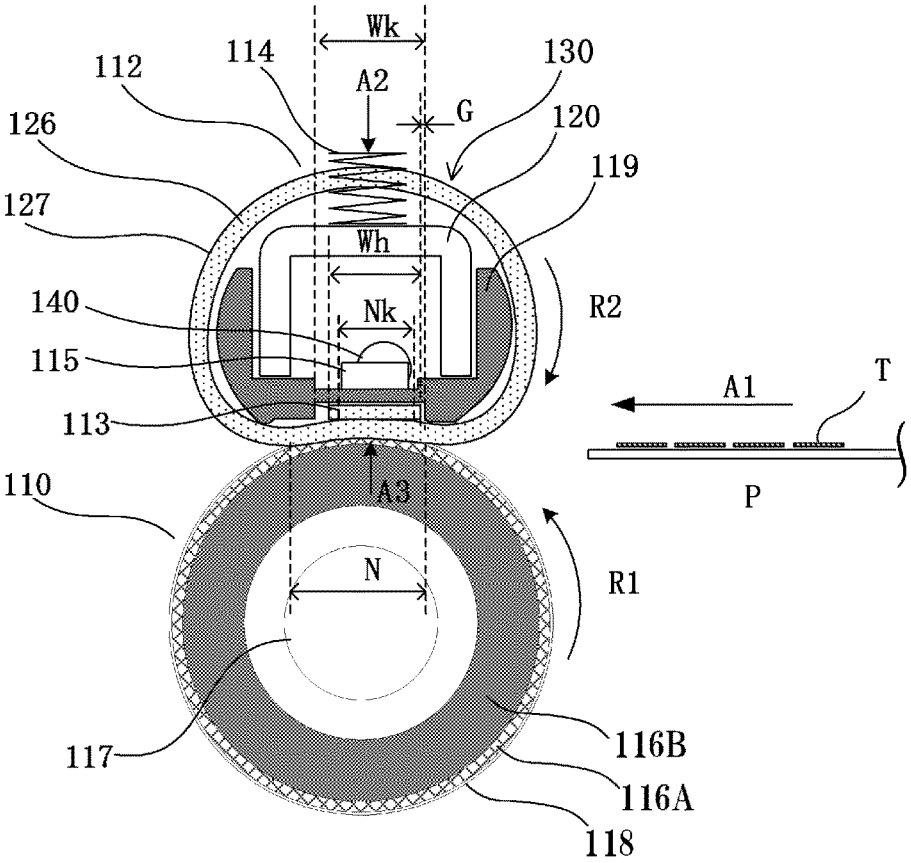
FIG. 2B is a sectional view thereof.

The image heating device 100 according to Example 1 is a heating device by a film heating method and is adapted to reduce the rising time and power consumption as described above. FIG. 2B is a sectional view of the image heating device 100 according to the example.

The image heating device 100 includes a heating unit 130 including a fixing film 112 serving as a heating rotary member, and a pressure roller 110 which forms a fixation nip N as a nip part together with the heating unit 130 and fixes a toner image by heating while transporting the recording material P which bears the toner image by the fixation nip N.

The heating unit 130 includes the fixing film 112 and a heater 113 as a heating member provided in contact with the inner surface of the fixing film 112 to sandwich the fixing film 112, and the fixing film 112 is pressed against the heater 113 by the pressure roller 110 to form the fixation nip N.

The heater 113 is held by a heater holder 119, the flexible fixing film 112 (rotating member) in the cylindrical shape is provided therearound, and the pressure roller 110 (pressurizing member) is opposed to and in pressure contact with the heater 113 to sandwich the fixing film 112 between the heater and pressure roller 110. The heater 113 contacts the inner surface of the fixing film 112 to form the inner surface nip Nk, and heat from the heater 113 is transmitted to the fixing film 112 by the inner surface nip Nk, so that the fixing film 112 is heated. Meanwhile, the surface of the fixing film 112 contacts the surface of the pressure roller 110 and forms the fixation nip N.

When the pressure roller 110 is driven in the direction of the arrow R1 in FIG. 2B, the fixing film 112 is provided with motive power from the pressure roller 110 at the fixation nip N and driven to rotate in the direction of the arrow R2. The heat of the fixing film 112 heated by the heater 113 at the fixation nip N is transmitted to the pressure roller and the pressure roller 110 is also heated. When the recording material P transferred with an unfixed toner image T is transported to the fixation nip N in the direction of the arrow A1 in FIG. 2B, the heat from the fixing film 112 and the pressure roller 110 heated at the fixation nip N is transmitted to the recording material P and the toner image T, and the toner image T is fixed on the recording material P.

Fixing Film

The heater holder 119 which holds the heater 113 is supported by an iron stay 120 for reinforcement on the opposite side to the heater 113. The flexible fixing film 112 in the cylindrical shape is provided therearound. The fixing film 112 according to the example has an outer diameter of ϕ20 mm in a non-deformed cylindrical state and has a multi-layer structure in the thickness-wise direction. As for the layer arrangement, the fixing film 112 includes a base layer 126 for keeping the strength of the film and a release layer 127 for reducing contaminant sticking to the surface. The material of the base layer 126 must have heat resistance for receiving heat from the heater 113 and strength for sliding against the heater 113, and therefore a metal such as stainless used steel (SUS) and nickel or a heat-resistant resin such as polyimide may be suitable. The metal having stronger strength than the resin can be made thinner than the resin and its higher thermal conductivity allows heat from the heater 113 to be transmitted more easily to the surface of the fixing film 112. The resin having a smaller specific gravity and thus a smaller thermal capacity than the metal is more easily heated. The resin can be formed into a thin film by coating molding and therefore the film can be manufactured less costly. According to the example, a polyimide resin was used as the material of the base layer 126 of the fixing film 112, and a carbon-based filler was added in order to increase the thermal conductivity and the strength. As the thickness of the base layer 126 is reduced, heat from the heater 113 can be more easily transmitted to the surface of the fixing film 112 while the strength is reduced, and therefore the thickness is preferably about in the range from 15 μm to 100 μm and set to 50 μm according to the example.

The material of the release layer 127 of the fixing film 112 may preferably be a fluororesin such as perfluoroalkoxy resin (PFA), polytetrafluoroethylene resin (PTFE), and tetrafluoroethylene-hexafluoropropylene resin (FEP), and PFA having a high releasability and a high thermal resistance among fluororesin was used according to the example. The release layer 127 may be a tube provided as a coating while the surface may be coated with a paint, and the release layer 127 is formed by providing a coating suitably adapted for thin-wall molding according to the example. As the release layer 127 is thinner, heat from the heater 113 is more easily transmitted to the surface of the fixing film 112, while if the release layer 127 is too thin, the durability of the film is lowered, and therefore the thickness is preferably about in the range from 5 μm to 30 μm and set to 10 μm according to the example.

Heater

The heater 113 is produced by coating a surface of an alumina substrate in a rectangular shape having a width Wh of 6 mm in the recording material transport direction, a length of 270 mm, and a thickness of 1 mm with a conduction heat generation resistance layer of Ag/Pd (silver-palladium) as thick as 10 μm by screen printing and providing a heat generator protection layer of glass as thick as 50 μm thereon. The image forming apparatus according to the example has a maximum recording material width equal to the width of Letter-size, 216 mm, and the size in the longitudinal direction of the conduction heat generation resistance layer is 218 mm which is longer than Letter-size by 1 mm each on the left and right, so that the recording material can be sufficiently heated over the entire width of Letter-size. A temperature detecting element 115 for detecting the temperature of a ceramic substrate having its temperature raised according to heat generation by the conduction heat generation resistance layer is provided at the back of the heater 113. In response to a signal from the temperature detecting element 115, current passed through the conduction heat generation resistance layer from an electrode part (not shown) at a longitudinal end is appropriately controlled, so that the temperature of the heater 113 is adjusted. Meanwhile, a safety element 140 is also provided at the back of the heater 113. This is for the purpose of preventing ignition by cracking of the heater if the temperature of the heater 113 is abnormally raised by continuous conduction of electricity to the heater in the case where the temperature detecting element 115 fails. The safety element 140 according to the example is a general thermostatic switch and connected in series to a conductive wire for conducting electricity to the heater 113. When the temperature of the safety element 140 (the temperature at the back of the heater 113) reaches 270° C., the bimetal therein deforms to cut off the conduction of electricity to the heater 113. If the temperature detecting element 115 fails, and the temperature at the back of the heater 113 reaches 270° C., the conduction of electricity is cut off by the safety element 140, and the heater 113 stops to be heated, so that ignition by cracking of the heater can be prevented.

Heat from the heater 113 heated while its temperature is adjusted using the temperature detecting element 115 is transmitted from the inner surface of the fixing film 112 to the outer surface and heats the surface of the pressure roller 110 through the fixation nip N. When the recording material P having the toner image T transferred thereon as described above is transported to the fixation nip N, the heat of the fixing film 112 and the pressure roller 110 is transmitted to the toner image T and the recording material P, so that the toner image T is fixed on the recording material P.

Heater Holder

Now, the heater holder 119 will be described.

As described above, the heater 113 is held as being fitted in the groove provided in the heater holder 119. The heater holder 119 is preferably made of a material with low thermal capacity which removes little heat from the heater 113, and liquid crystal polymer (LCP) as heat-resistant resin is used according to the example. The heater holder 119 is supported by the iron stay 120 for reinforcement on the opposite side to the heater 113. The stay 120 is pressurized by a pressure spring 114 in the direction of the arrow A2 in FIG. 2B from opposed ends in the longitudinal direction.

Pressure Roller

The pressure roller 110 according to Example 1 has an outer diameter of ϕ20 mm and includes an iron mandrel 117 having a diameter of ϕ13 mm, and an elastic layer 116

(foamed rubber) formed on the mandrel 117, having a thickness of 3.5 mm, and produced by foaming silicone rubber. As the pressure roller 110 has higher thermal conductivity, heat on the surface of the pressure roller 110 is easily absorbed to the inner side, and the surface temperature of the pressure roller 110 is less easily to rise. More specifically, use of a material which has a heat capacity as low as possible and a low thermal conductivity and provides a high insulation effect can reduce the rising time of the surface temperature of the pressure roller 110.

The thermal conductivity of the foamed rubber produced by foaming silicone rubber is from 0.06 W/m·K to 0.16 W/m·K and lower than that of solid rubber which is from 0.20 W/m·K to 2.00 W/m·K. The specific gravity of solid rubber related to the thermal capacity is about from 1.05 to 1.30, while the specific gravity of foamed rubber is about from 0.75 to 0.85, and the foamed rubber has low heat capacity. Therefore, use of the foamed rubber can reduce the rising time of the surface temperature of the pressure roller 110.

While as the outer diameter of the pressure roller 110 is smaller, the heat capacity can be reduced, the width of the fixation nip N is reduced for too small a diameter, therefore an appropriate diameter must be secured, and the outer diameter is ϕ20 mm according to the example. If the thickness of the elastic layer 116 is too small, sufficient deformation cannot be achieved, and the fixation nip N cannot be formed. Therefore, the layer needs an appropriate thickness, and the thickness of the elastic layer 116 is 3.5 mm according to the example.

A release layer 118 of perfluoroalkoxy resin (PFA) is formed on the elastic layer 116 as a release layer for toner. The release layer 118 may be produced by providing a tube as a cover or coating the surface similarly to the release layer 127 of the fixing film 112, and the tube having high durability is used according to the example. The material of the release layer 118 may be fluororesin such as PTFE and FEP as well as PFA or fluoro-rubber or silicone rubber with high releasablity. As the surface hardness of the pressure roller 110 is lower, the width of the fixation nip N is increased under light pressure, but the durability is lowered for excessively low hardness, and therefore the pressure roller 110 according to the example has a surface hardness of 50° according to Asker-C hardness (with a load of 4.9 N), and the pressurizing force is 180 N.

The pressure roller 110 is configured to rotate at a surface movement speed of 273 mm/sec in the direction of the arrow R1 in FIG. 2B by rotating unit which is not shown. Now, the layer arrangement and physical properties of the pressure roller 110 and a manufacturing method therefor will be described in detail.

Layer Arrangement of Pressure Roller

Now, the layer arrangement of the pressure roller 110 according to Example 1 will be described in detail.

Figure 1A:
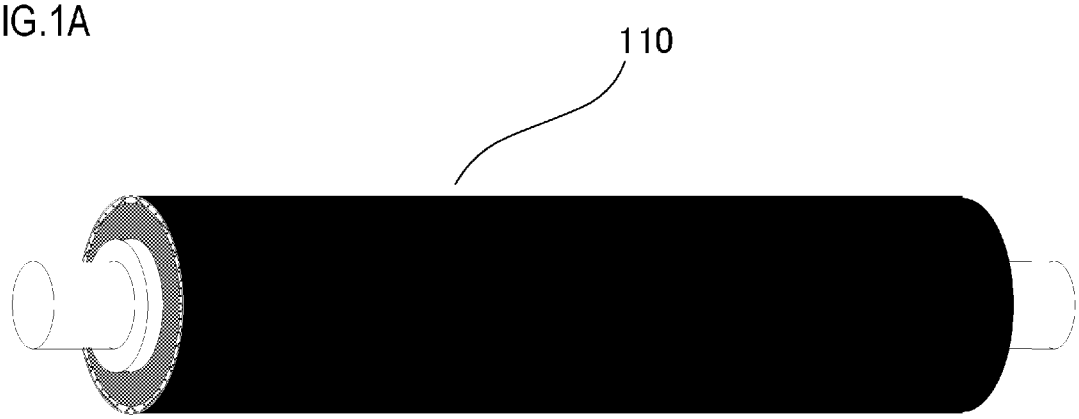
FIG. 1A is a perspective view of a pressure roller in an image heating device according to Example 1 of the present invention.
Figure 1B:
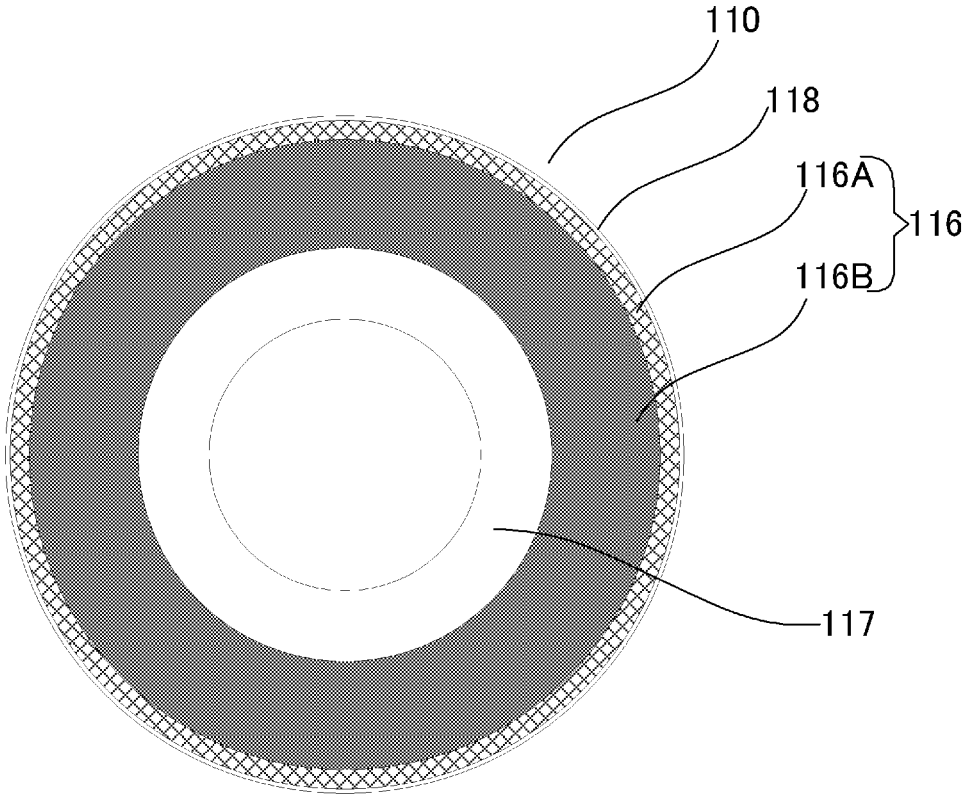
FIG. 1B is a sectional view thereof.

FIG. 1A is a bird's-eye view of the pressure roller 110, and FIG. 1B is a sectional view thereof.

As shown in FIGS. 1A and 1B, the pressure roller 110 includes at least the mandrel 117, the elastic layer 116, and the release layer 118. The elastic layer 116 includes silicone rubber, and the release layer 118 is made of fluororesin or the like.

The mandrel 117 is made of iron, aluminum or the like and formed in a solid or hollow cylindrical shape to have rigidity required by the pressure roller 110. According to the example, the mandrel is made of an iron solid column having a diameter of ϕ13.

The elastic layer 116 includes at least two layers and includes the first elastic layer 116A on the side of the release layer 118, and the second elastic layer 116B provided between the mandrel 117 and the first elastic layer 116A. The first elastic layer 116A has voids, which shortens the rising time. The second elastic layer 116B is formed from solid rubber or solid rubber containing a high thermal conductive filler. In this way, a sufficient effect for restricting temperature rise at the non-paper-passing part.

The voids in the first elastic layer 116A are open-cell voids, so that gloss unevenness can be reduced as will be described.

The release layer 118 is provided in consideration of toner releasability during printing and may have its thickness set within an arbitrary range which allows the effect of the present invention to be secured. In general, the thickness is from 10 μm to 50 μm. Examples of the material of the release layer 118 include fluororesin materials such as polytetrafluoroethylene (PTFE), tetrafluoroethylene-perfluoroalkylvinylether (PFA), and tetrafluoroethylene-hexafluoropropylene (FEP).

The relation between the thickness-wise thermal conductivity $\lambda 1$ of the first elastic layer 116A and the thickness-wise thermal conductivity $\lambda 2$ of the second elastic layer 116B is represented by $\lambda 1<\lambda 2$. This is because the first elastic layer 116A is provided for the purpose of preventing diffusion of thermal energy generated by the heating member in a short period at the rising time and requires thermal insulation.

The relation between the thickness t1 of the first elastic layer 116A and the thickness t2 of the second elastic layer 116B is preferably represented by t1<t2. The first elastic layer 116A must be a thin layer because the layer must exhibit thermal insulation in a short period at the rising time and serve to soak the second elastic layer 116B in relation to overall temperature rise in association with passing of sheets. The elastic layer 116 must have elasticity necessary for forming a nip and a certain thickness in addition to the elasticity for the purpose, and the second elastic layer 116B is thicker than the first elastic layer 116A.

The thicknesses of the first elastic layer 116A and the second elastic layer 116B were measured by forming a section using a razor so that the section is formed orthogonally to the axis of the mandrel from the pressure roller 110 and observing the section under an optical microscope. The thickness was measured in three arbitrary positions, and the respective arithmetic means thereof are the thicknesses of the first elastic layer 116A and the second elastic layer 116B.

First Elastic Layer

The first elastic layer 116A has open-cell voids as described above. When the voids in the first elastic layer 116A are closed-cell voids instead of open-cell voids, gas expansion caused by temperature rise or pressure increase in the voids generated during compression of the elastic layer may cause unevenness in pressure applied by the pressure roller 110 upon paper, which is more likely to cause gloss unevenness.

In contrast, according to the present invention, the first elastic layer 116A has open-cell voids, and therefore pressure generated by gas expansion caused by temperature rise or compression of the elastic layer may be dissipated, so that pressure applied by the pressure roller 110 on paper can be homogenized, and therefore the gloss unevenness can be reduced.

The first elastic layer 116A has a thickness t1 of at least 50 μm and not more than 500 μm. When the thickness is less than 50 μm, the layer cannot be formed. The effect of reducing the rising time may be insufficient. When the thickness is larger than 500 μm, the effect of reducing temperature rise at the non-paper-passing part by the second elastic layer 116B may not be sufficiently provided. This is because as the printing speed has become higher, which causes even severe temperature rise at the non-paper-passing part, the first elastic layer 116A must be thinner than in the conventional cases in order to sufficiently improve the printing capability while restraining temperature rise at the non-paper-passing part.

The first elastic layer 116A preferably has an open-cell foam ratio of at least 70% and not more than 100%.

When the open-cell foam ratio is at least 70%, gloss unevenness can be reduced. For higher open-cell foam ratios, gloss unevenness can be more reduced.

The thickness-wise thermal conductivity λ1 of the first elastic layer 116A is preferably at least 0.06 W/(m·K) and not more than 0.16 W/(m·K). This is because if the thermal conductivity is less than 0.06 W/(m·K), the porosity is too high, and the amount of rubber is scarce, which makes molding difficult or the pressure roller 110 may have low durability as a fixation device, while if the thickness-wise thermal conductivity exceeds 0.16 W/(m·K), the effect of reducing the rising time is reduced.

The porosity of the first elastic layer 116A is preferably at least 20% by volume and not more than 70% by volume. For a porosity less than 20% by volume, the above-described open-cell foam ratio cannot be obtained, and in order to obtain a porosity not less than 70% by volume, the amount of rubber is too scarce, which makes molding difficult. For higher porosities, the rising time can be more reduced, and the porosity is more preferably at least 35% by volume and not more than 70% by volume.

The porosity of the first elastic layer 116A can be obtained from the following expression.

To start with, using a razor, the first elastic layer 116A is cut along an arbitrary part. The volume thereof at 25° C. is measured by an immersion density measuring device (SGM-6 manufactured by Mettler-Toledo International Inc.) (Hereinafter, the volume will be referred to as Vall.).

Now, an evaluation sample after the volume measurement is heated at 700° C. for one hour in a nitrogen gas atmosphere using a thermogravimetry device (trade name: TGA851e/SDTA manufactured by Mettler-Toledo International Inc.) and the silicone rubber component thereof is thus decomposed and removed. The reduced amount of the weight at the time is Mp.

In this state, the volume at 25° C. is measured using a dry automatic densimeter (trade name: Acupic 1330-1 manufactured by Shimadzu Corporation) (Hereinafter, the density will be referred to as Va.). The porosity can be obtained on the basis of these values from the following expression (1).

Note that calculation was carried out as the density of the silicone rubber component is 0.97 g/cm$^3$ (Hereinafter the density will be referred to as ρp.).

$$\text{The porosity (\% by volume)}=[\{(Vall-(Mp/\rho p+Va)\}/Vall]\times 100 \quad (1)$$

Note that the porosity according to Example 1 is obtained as an average value of five samples in total cut out as arbitrary parts.

Open-cell voids in the first elastic layer 116A can be formed by void forming unit using hollow particles of resin or hydrogel.

An example of the means for providing open-cell voids formed by hollow particles of resin is means for molding the resin in a state flocculated by triethyleneglycol (TEG) or the like.

The flocculant is preferably a substance which has high conformability with the expanded resin micro balloons and low conformability with silicone rubber and is evaporated at least at a temperature at which the resin of the resin micro balloons is soften or melts. The component to be evaporated is preferably at least one selected from the group consisting of ethylene glycol, diethylene glycol, triethylene glycol, and glycerin. The above substances are each assumed to efficiently cover the surface of the resin balloons in the resin balloon-mixed silicone rubber material and serve to accelerate forming of an open-cell foam structure in the resin balloon-mixed silicone rubber.

As for the mixing amount, the total amount of ethylene glycol, diethylene glycol, triethylene glycol, and glycerin is preferably one to two times (by weight part) the mixing amount of resin balloons. If the amount is less than the above, the effect may not be easily provided, which is disadvantageous, and the amount more than the above adversely affects the curability/heat resistance of silicone rubber, which is also disadvantageous.

Second Elastic Layer

The second elastic layer 116B is made of solid rubber or solid rubber containing a high thermal conductive filler. This is because the effect of reducing temperature rise at the non-paper-passing part can be provided. In order to improve the thermal conductivity, the high thermal conductive filler for example of alumina, zinc oxide, silicon carbide, or graphite is added to a base polymer, so that the second elastic layer 116B has high thermal conductivity.

The second elastic layer 116B preferably has a thickness-wise thermal conductivity in the range of at least 0.2 W/(m·K) and not more than 2.0 W/(m·K).

This is because if the thermal conductivity is less than 0.2 W/(m·K), the effect of reducing temperature rise at the non-paper-passing part cannot be fully provided, while if the thermal conductivity exceeds 2.0 W/(m·K), the molding may be difficult, or it may be difficult to obtain sufficient elasticity for forming a nip by high filling of a high thermal conductive filler. As the thickness-wise thermal conductivity λ2 of the second elastic layer 116B increases, heat staying in the pressure roller 110 can be passed through the mandrel 117 present in the thickness-wise direction and soaked in the longitudinal direction through the mandrel 117 when the temperature rises at the non-paper-passing part, so that the temperature rise at the non-paper-passing part can be restrained.

The content of the high thermal conductive filler is preferably at least 1% by volume and not more than 60% by volume. If the content is less than 1% by volume, an expected thermal conductivity may not be provided, while if the content exceeds 60% by volume, the molding may be difficult, or it may be difficult to obtain sufficient elasticity for forming a nip by high filling of a high thermal conductive filler.

According to a method for measuring the content (% by volume) of the high thermal conductive filler in the second elastic layer 116B, a sample is cut from the second elastic layer 116B and then the volume thereof (Vall) at 25° C. is measured by a liquid specific gravity measurement device (SGM-6 manufactured by Mettler-Toledo International Inc.).

Then, the evaluation sample having its volume measured is heated at 700° C. for one hour in a nitrogen gas atmosphere using a thermogravimetry device (trade name: TGA851e/SDTA manufactured by Mettler-Toledo International Inc.), and the silicone rubber component thereof is decomposed and removed.

Then, the volume of the remaining high thermal conductive filler at 25° C. is measured using a dry automatic densimeter (trade name: Acupic 1330-1 manufactured by Shimadzu Corporation) (Hereinafter, the volume will be referred to as Vb.). The volume fraction of the high thermal conductive filler can be obtained from the following expression (2) on the basis of these values.

$$\text{The content of the high thermal conductive filler (\% by volume)} = (Vb/Vall) \times 100 \quad (2)$$

Base Polymer

Base polymers for the first elastic layer 116A and the second elastic layer 116B are obtained by cross-linking and curing addition-curable liquid silicone rubber. The addition-curable liquid silicone rubber is non-crosslinked silicone rubber having organopolysiloxane (A) having an unsaturated bond such as a vinyl group and organopolysiloxane (B) having an Si—H bond (hydride). Cross-linking and curing proceeds as Si—H have an addition reaction to the unsaturated bond such as the vinyl group by heating or the like.

As for a catalyst which accelerates the reaction, (A) generally contains a platinum compound. The addition curable liquid silicone rubber can have its fluidity adjusted within the range in conformity with the object of the present invention.

Note that according to the present invention, unless departing from the scope of the features of the present invention, fillers or filling materials, or compounding agents which are not disclosed herein may be included in the first elastic layer 116A and the second elastic layer 116B as a solution to a known problem.

Method for Evaluating Thermal Conductivity in Longitudinal and Thickness-Wise Directions of Second Elastic Layer The longitudinal and thickness-wise thermal conductivity of the second elastic layer 116B can be obtained as follows.

Figure 3:
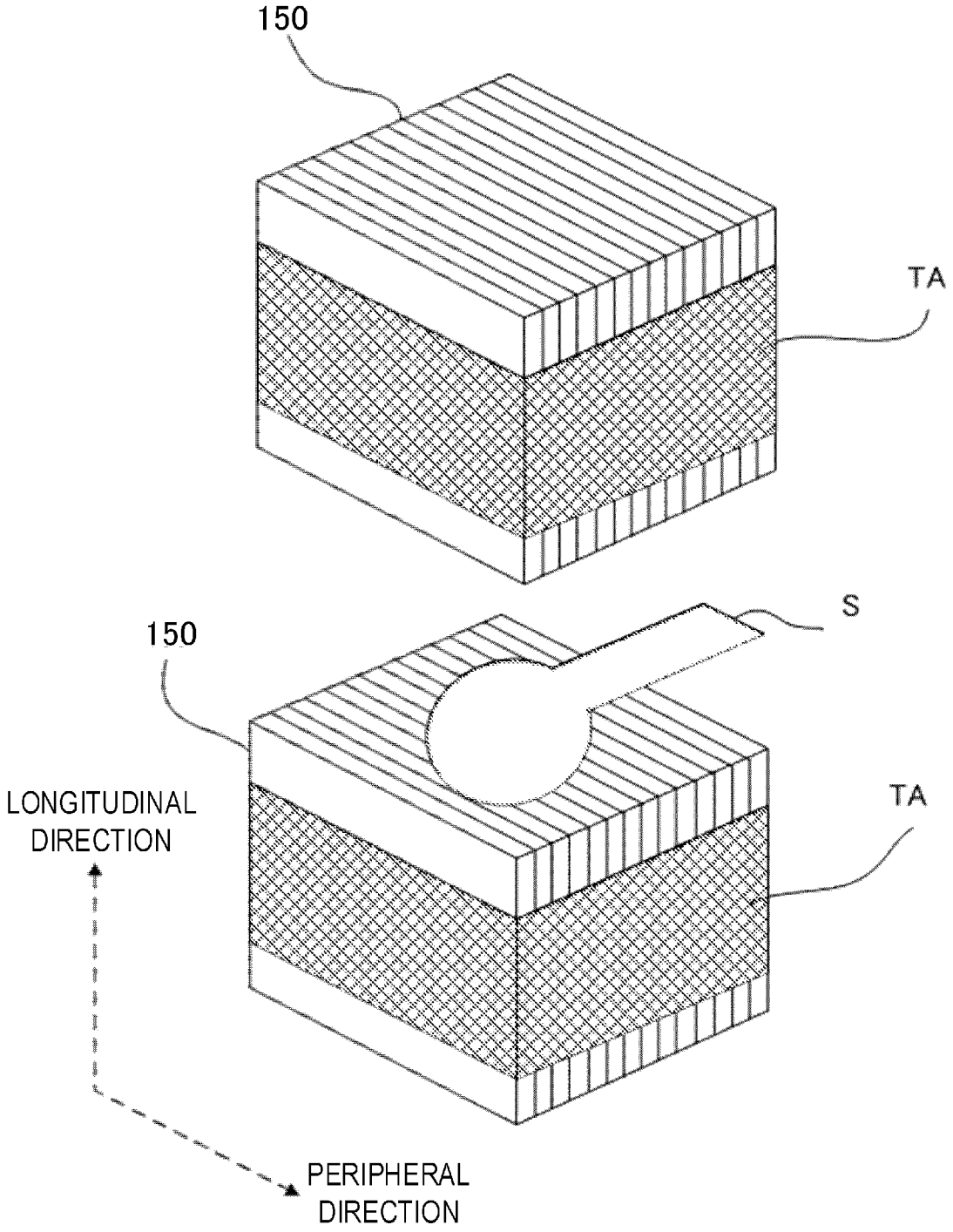
FIG. 3 is a view for illustrating a sample and a measuring system in relation to thermal conductivity measurement.

A sample is cut from the second elastic layer 116B of the pressure roller 110 using a razor. Referring to FIG. 3, measurement of the longitudinal thermal conductivity and the thickness-wise thermal conductivity will be described.

FIG. 3 shows a sample for evaluating thermal conductivity (hereinafter as "measurement sample") produced by joining together samples 150 cut into a shape having 15 mm in the peripheral direction, 15 mm in the length-wise direction, and a thickness (thickness of an elastic layer) so that the total thickness is about 15 mm.

When the thermal conductivity in the longitudinal direction is measured, an adhesive tape TA having a thickness of 0.07 mm and a width of 10 mm is used to fix the measurement sample as shown in FIG. 3.

Then, a measurement surface and the back surface of the measurement surface opposed to the measurement surface are cut in order to level the measurement surface. Then, two sets of the measurement samples are prepared, and a sensor S is sandwiched by the samples to carry out measurement.

As for the measurement, an anisotropic thermal conductivity is measured using a thermal physical property measurement device according to hot disk method TPA-501 (manufactured by Kyoto Electronics Manufacturing Co., Ltd.). Each sample is measured five times and the average of the results is calculated as a longitudinal thermal conductivity.

Note that the thickness-wise thermal conductivity is measured similarly to the above while the measurement sample is changed in the direction.

Method for Evaluating Thickness-wise Thermal Conductivity of First Elastic Layer The thickness-wise thermal conductivity of the first elastic layer 116A can be obtained as follows.

A sample is cut from the first elastic layer 116A of the pressure roller 110 using a razor. The specific heat Cp (J/(k·kg)) of the sample was measured using the differential scanning calorimetry device DSC823e (trade name, manufactured by Mettler-Toledo International Inc.). The density ρ ($kg/m^3$) was measured using a liquid specific gravity measurement device (SGM-6 manufactured by Mettler-Toledo International Inc.). Using these values, a sample was set in the direction in which the thermal conductivity in the thickness-wise direction of the pressure roller 110 can be measured by a thermal conductivity measuring device (ai-Phase Mobile 2 manufactured by ai-Phase Co., Ltd.) and the thermal conductivity was obtained.

Method for Evaluating Open-cell Foam Ratio

The first elastic layer 116A according to the present invention has such an open-cell foam ratio that voids account for at least 70% and not more than 100% in order to reduce gloss unevenness. The open-cell foam ratio of the first elastic layer 116A can be calculated according to the following expression (3) by a method for replacing the voids with water as follows by cutting the first elastic layer 116A along an arbitrary part.

$$\text{Open-cell foam ratio (\%)} = \{(\text{volume of absorbed water})/Vall-(Mp/\rho p+Va))\} \times 100 \quad (3)$$

Note that the volume of absorbed water can be obtained from the following expression (4).

$$\text{Volume of absorbed water} = (\text{sample mass after water absorption} - \text{sample mass before water absorption})/\text{water density} \quad (4)$$

Note that the water density is 1.0 $g/cm^3$ according to the example.

According to the method for replacing the voids by water, the sample was held in water and made to stand for 3 minutes under reduced pressure of −750 mmHg. The sample mass before replacing the voids by water is referred to as the sample mass before water absorption and the sample mass having the voids replaced by water is referred to as the sample after water absorption. Note that Vall, Mp, ρp, and Va are the same as those described above.

Method for Manufacturing Pressure Roller

By the manufacturing method as follows, the pressure roller 110 which allows the temperature rise at the non-paper-passing part and the rising time to be reduced while reducing gloss unevenness can be provided.

(i) Step of Adjusting Material for Second Elastic Layer

A prescribed amount of a high thermal conductive filler or an acicular filler is measured and mixed to non-crosslinked addition curable liquid silicone rubber. Known mixing unit such as a planetary universal agitator is used for mixing and a liquid composition for forming the second elastic layer is prepared. At the time, when the second elastic layer 116B having a high thermal conductive filler is formed, addition of an increased amount of the high thermal conductive filler can raise the thickness-wise thermal conductivity of the second elastic layer 116B. When the second elastic layer 116B having an acicular filler is formed, addition of an increased amount of the acicular filler can increase the longitudinal thermal conductivity of the second elastic layer 116B.

(ii) Step of Molding Second Elastic Layer 116B

The liquid composition prepared in (i) is injected into a cavity for cast molding having the mandrel 117 having its surface primer-treated.

When the second elastic layer 116B having an acicular filler 160 is formed at the time, the liquid composition is injected in the cavity so that the filler is oriented in the longitudinal direction of the roller. In this way, the acicular filler 160 is oriented approximately in the longitudinal direction, so that the longitudinal thermal conductivity can effectively be increased.

The thickness of the second elastic layer 116B can be controlled by voids in the cavity.

After the injection to the mold, the composition for forming the second elastic layer is cured by heating at 100° C. to 150° C. for about at least 10 minutes and released, and the second elastic layer 116B can be formed on the mandrel 117.

Note that the molding step can be carried out by known means such as ring coating.

(iii) Step of Preparing Material for first Elastic Layer 116A

A prescribed amount of hollow particles or hydrogel is measured and mixed to the non-crosslinked addition curable liquid silicone rubber. Known mixing unit such as a planetary universal agitator is used for mixing and a liquid composition for forming the first elastic layer is prepared. When voids are formed using hollow particles, a flocculant such as triethylene glycol (TEG) is used and mixed in order to form open-cell voids. An increased amount of the flocculant raises the open-cell foam ratio. When voids are formed using hydrogel, mixing is carried out until a liquid composition attains an emulsion state. Note that the porosity is increased by increasing the amount of the hollow particles or hydrogel, and the thickness-wise thermal conductivity of the first elastic layer 116A can be lowered.

(iv) Step of Molding First Elastic Layer 116A

The pressure roller including the mandrel 117 and the second elastic layer 116B formed thereon is provided in a cavity for cast molding, and the liquid composition prepared in (iii) is injected therein.

After injecting the liquid composition in the mold, the composition for forming the second elastic layer can be cured by heating the composition at a temperature about in the range from 100° C. to 150° C. for at least 10 minutes and released while the mold is kept in a sealed state, and the molded first elastic layer 116A can be formed on the second elastic layer 116B.

Gaps in the cavity to be injected with the liquid composition prepared in (iii) allow the thickness of the second elastic layer to be controlled. After molding the first elastic layer 116A, the thickness of the first elastic layer 116A may be reduced to a desired thickness by known rubber polishing process.

The first elastic layer 116A and the second elastic layer 116B may be adhered with each other, as required and appropriate, by applying an adhesive or primer on the surface of the second elastic layer 116B.

When voids are formed by the void forming means using hydrogel, the liquid composition should be cured and then released, and the moisture of the hydrogel should be removed by heating at least at 100° C., so that voids are formed.

As for thermal treatment conditions for dehydration, it is preferable that the temperature is from 100° C. to 250° C. and the heating period is from 1 to 5 hours.

(v) Step of Stacking Release Layer 118

In consideration of the toner releasability during printing, a fluororesin tube of PFA may be provided as the release layer 118 for the roller.

Using an adhesive, the fluororesin tube as the release layer 118 is provided to cover the first elastic layer 116A and integrated therewith. When the release layer 118 is adhered with the first elastic layer 116A without using an adhesive, the adhesive is not necessary. Note that the release layer 118 does not have to be formed last in the step, and the release layer 118 can be stacked in advance by a cast molding method for providing the tube inside the mold before the liquid composition in (iv) is injected.

Manufacture of Pressure Roller According to Example

In the following example, the first elastic layer of open-cell foam balloon rubber according to the example has a thickness of 100 μm.

High purity spherical alumina is added and mixed as a high thermal conductive filler to non-crosslinked addition curable liquid silicone rubber in the volume percentage of 20% by volume in a volume percentage, and a liquid composition for forming the second elastic layer is obtained. The high purity spherical alumina, "Alunabeads CB-A30S," (trade name, manufactured by Showa Denko K.K.) was used. Then, the center of the mandrel 117 having an outer diameter of ϕ13 mm and primer-treated in advance by known means for adhesion with the second elastic layer 116B is set to be coaxial with the center of a molding mold having an inner diameter of ϕ19.8 mm.

Note that the primer included liquid A and liquid B of "DY39-051" (trade name, manufactured by Dow Corning Toray Co., Ltd.).

The liquid composition for forming the second elastic layer 116B is injected between the mandrel 117 and the mold in the longitudinal direction of the mold from an injection hole for an end mold at a side surface of the molding mold. Then, curing by heating was carried out at 150° C. for 30 minutes, followed by releasing, so that a roller including the mandrel and the second elastic layer formed thereon was obtained.

Then, the liquid composition for forming the first elastic layer 116A was added and mixed. Three weight parts of expanded resin micro balloons (trade name: F-80SDE manufactured by Matsumoto Yushi-Seiyaku Co., Ltd.), and 6 weight parts of triethylene glycol were added relative to 100 weight parts of non-crosslinked addition curable liquid silicone rubber, and the mixture was stirred for 10 minutes at room temperatures by a universal mixing agitator (Dalton Corporation/Sanei Seisakusho Co., Ltd.), and the liquid composition for forming the first elastic layer 116A was obtained. Then, the roller having the second elastic layer 116B stacked thereon is set to be concentric with the center of the molding mold having an inner diameter of 23 mm. Then, the liquid composition for forming the first elastic layer 116A was injected in the mold. Then, the mold was closed and cured by heating for one hour using an oven set at 130° C., followed by releasing. Then, the thermally cured roller was subjected to heating treatment for two hours in the oven set at 230° C. Rubber polishing treatment was carried out, so that the first elastic layer was adjusted in thickness, so that the roller has an outer diameter of ϕ20 mm. Finally, using liquid A and liquid B of "SE1819CV" (trade name, manufactured by Dow Corning Toray Co., Ltd.), a PFA tube is adhered to the surface of the first elastic layer 116A by known means, an excessive part of the end surface was cut off, and the pressure roller 110 according to Example 1 was manufactured.

The first elastic layer 116A of the manufactured pressure roller 110 had a thickness of 100 μm. The open-cell foam ratio of the first elastic layer 116A was 90%. The thickness-wise thermal conductivity of the first elastic layer 116A was 0.10 W/m·K. The thickness-wise thermal conductivity of the second elastic layer 116B was 0.41 W/m·K. In this example, molds having different inner diameters were used as appropriate according to the desired first elastic layer 116A so that the total thickness of the first and second elastic layers was 3.5 mm when the thickness of the first elastic layer 116A of open-cell foam balloon rubber was 50 μm, 300 μm, 500 μm, and 0 mm. While the pressure roller 110 having the first elastic layer 116A the thickness of which was changed among the above was measured for the open-cell foam ratio of the first elastic layer 116A, the thickness-wise thermal conductivity of the first elastic layer 116A, and the thickness-wise thermal conductivity of the second elastic layer 116B, the results indicated no significant difference and therefore will not be described.

Advantageous Effects of Example

According to the example, rubber having open-cell voids was thinned and provided as the first elastic layer 116A on the outer surface side, while the second elastic layer 116B of solid rubber was provided on the inner side, and quick rising and reduction of the temperature rise at the non-paper-passing part were both achieved. Gloss unevenness in output images can be prevented by restraining unevenness in surface shapes and pressure caused by heating. Expansion unevenness caused by quick temperature rise would be severe in the case of closed-cell voids because of difference in expansion coefficient between the rubber part and the void part, while such expansion unevenness can be reduced by open-cell foaming, so that homogeneous high picture quality output can be achieved.

In order to confirm the advantageous effect of the example, comparative tests were conducted using a pressure roller of balloon rubber (Comparative Example 1), a pressure roller of solid rubber (Comparative Example 2), a pressure roller having the first elastic layer 116A of closed-cell foam balloon rubber, the thickness of which was varied among 50 μm, 100 μm, 300 μm, and 500 μm (Comparative Examples 3 to 6), and a pressure roller having the first elastic layer 116A of open-cell foam balloon rubber, the thickness of which was varied among 50 μm, 100 μm, 300 μm, and 500 μm (Examples 1-1 to 1-4) according to the inventive example.

The pressure roller of balloon rubber in Comparative Example 1 is a single elastic layer produced using the material used for the first elastic layer 116A according to the inventive example and has an outer diameter of ϕ20 mm, and the thickness-wise thermal conductivity is the same as that of the first elastic layer in Example 1.

The pressure roller of solid rubber in Comparative Example 2 is a single elastic layer produced using the material used for the second elastic layer according to the inventive example and having an outer diameter of ϕ20 mm, and the thickness-wise thermal conductivity thereof is the same as the second elastic layer in Example 1.

The pressure roller of closed-cell foam balloon rubber in Comparative Examples 3 to 8 is a roller produced without triethylene glycol to have the same thickness-wise thermal conductivity of the first elastic layer and the same thickness-wise thermal conductivity of the second elastic layer as those in Example 1.

The rollers of closed-cell foam balloon rubber having various thicknesses all have an open-cell foam ratio of 5% or less.

Comparison about Rising

A film heating type fixation device achieves quick rising taking advantage of small thermal capacity. The rising is quickened especially when the pressure roller is made of balloon rubber (Comparative Example 1). Meanwhile, the thermal capacity increases at the cost of quick starting performance even for the film heating method when the pressure roller is made of solid rubber (Comparative Example 2). Since the temperature of the film surface must be sufficiently raised in the time point in which a paper sheet to be fixed enters the nip, the fixation device was activated to rise from a cooled state, and the transitions of the film surface temperatures were compared and evaluated.

The comparison tests were conducted in an environment at a room temperature of 15° C. and with a humidity of 10%, the pressure rollers are assembled in identical image forming apparatuses, and the film surface temperatures in the rising operation from the cooled stationary state were measured using a thermos-viewer and compared. The image forming apparatus can operates at a process speed of 273 mm/sec and a printing speed of 48 ppm with an FPOT of 5.5 sec and the heating device can supply a maximum heat amount of 1043 W. In the series of tests, the film surface temperatures in the time point 4 seconds after the start of heating/rotating were compared. The test result is given in Table 1.

Result of Comparison Tests about Rising

TABLE 1

| | Comparative example 1 | Comparative example 2 | Example 1-1 | Example 1-2 | Example 1-3 | Example 1-4 |
|---|---|---|---|---|---|---|
| Balloon rubber | 3500 μm | — | 50 μm | 100 μm | 300 μm | 500 μm |
| Solid rubber | — | 3500 μm | 3450 μm | 3400 μm | 3200 μm | 3000 μm |
| Four-second temperature[° C.] | 196.9 | 168.9 | 177.2 | 183.1 | 187.9 | 191.4 |
| Attaining ratio[%] | 100.0% | 85.8% | 90.0% | 93.0% | 95.4% | 97.2% |

The four-second temperature is a temperature in the time point after 4 seconds, and the attaining ratio indicates, in percentage, comparison relative to the temperature of the pressure roller of balloon rubber as a reference. As can be understood from the test result, as for the balloon rubber (Comparative Example 1), good rising was achieved because of thermal insulation and low thermal capacity, while as for the solid rubber (Comparative Example 2), the film surface temperature was 30° C. lower. More specifically, when solid rubber is used, it takes longer time for rising and quick starting performance must be sacrificed.

Meanwhile, as can be understood, in the inventive example in which balloon rubber was used for the first elastic layer 116A, good rising is achieved though the rising depends on the thickness. In Example 1-1 with the thickness of 50 μm, the attaining ratio was 90.0%, in Example 1-4 with the thickness of 500 μm, the attaining ratio was 97.2%. As for the rising, if the thickness is too small, heat reaches the second elastic layer, which degrades the temperature rise at the film surface, so that the quick start performance is affected. Meanwhile, as the thickness increases, the layer should become asymptotical to the balloon roller, and the test result indicates that the layer does not become 100% asymptotical. This is probably attributable to the adhesive layer part in forming a multi-layer structure. However, it has been confirmed by the experiments that good quick start performance can be achieved by the approach according to the present invention.

Note that the first elastic layers of balloon rubber in the state of an open-cell foam and a closed-cell foam were subjected to tests but the result did not indicate any significant difference, and therefore the result will not be described.

Comparison of Temperature Rise at Non-Paper-Passing Part

When printing is carried out to a recording material having a shorter width than a maximum printable width, the fixation nip N has a region with a recording material (paper-passing region) and a region without a recording material (non-paper-passing region). When the heater 113 generates heat for the maximum width, thermal energy in the non-paper-passing region is received by the corresponding region of the pressure roller 110, and temperature unevenness is generated in the length-wise direction of the fixation device, so that the temperature increases at the non-paper-passing part. This is the temperature rise at the non-paper-passing part. In recent years, in order to improve quick starting performance, the insulation of the pressure roller 110 has been advanced, which is a disadvantageous feature in relation to the temperature rise at the non-paper-passing part. In relation to the temperature rise at the non-paper-passing part in general, balloon rubber having a small soaking effect is disadvantageous and solid rubber having a large soaking effect is advantageous. Comparison tests about the temperature rise at the non-paper-passing part were conducted using the above described pressure rollers.

Figure 4:
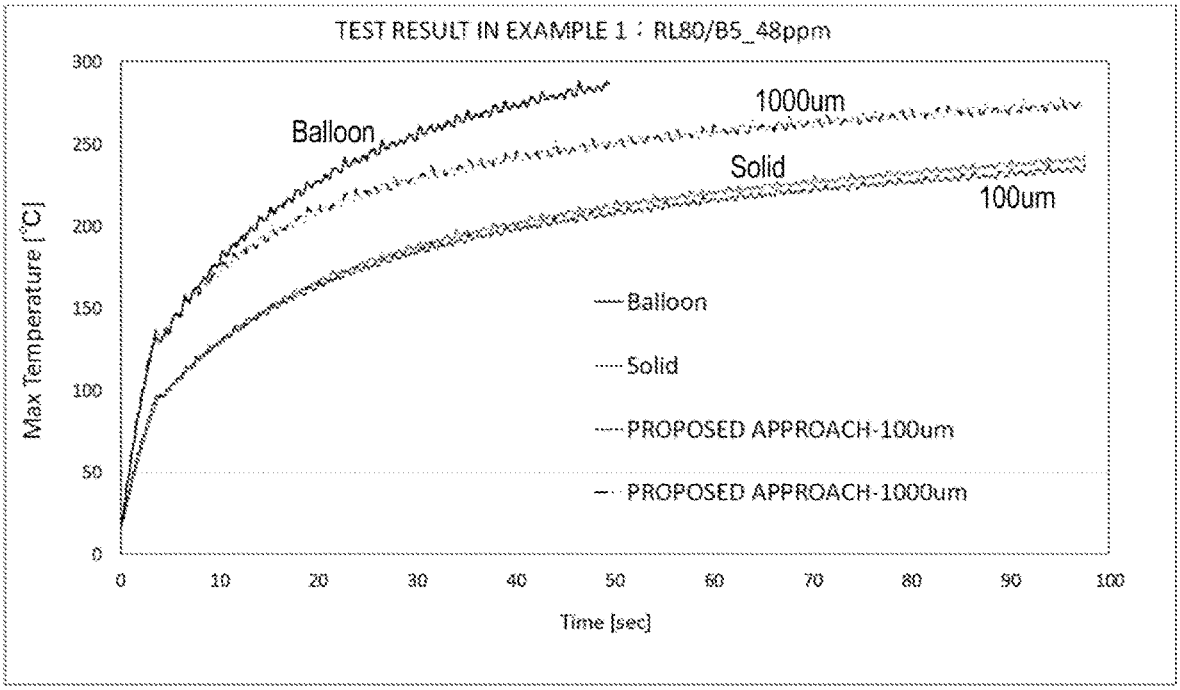
FIG. 4 is a view showing an experiment result according to Example 1.

Comparison tests were conducted in an environment at 15° C. with a humidity of 10%, the pressure rollers were assembled to identical image forming apparatuses, B5 sized paper sheets with a basis weight of 80 g were sequentially passed, and the pressure roller temperatures at the non-paper-passing parts were measured by a thermos viewer. In this example, at a maximum speed of 48 ppm, 75 sheets as a maximum number or the number of sheets until the pressure roller surface was destroyed by temperature rise were passed. The number of sheets until 230° C. is attained is indicated, since the pressure roller temperature must be controlled to be 230° C. or less according to the product design. This is because silicone rubber starts to deteriorate by heat when the temperature exceeds 200° C., and the temperature must be not more than 230° C. as an experimental threshold in consideration of the useful life of the product. The test result is given in Table 2, and a representative example of the test results is given in FIG. 4.

Result of Comparison Test about Temperature Rise at End

TABLE 2

| | Comparative example 1 | Comparative example 2 | Example 1-1 | Example 1-2 | Example 1-3 | Example 1-4 |
|---|---|---|---|---|---|---|
| Balloon rubber | 3500 μm | — | 50 μm | 100 μm | 300 μm | 500 μm |
| Solid rubber | — | 3500 μm | 3450 μm | 3400 μm | 3200 μm | 3000 μm |
| Maximum temperature[° C.] | 318.1 | 244.6 | 239.3 | 246.6 | 251.8 | 260.0 |
| Number of sheets until attaining 230° C. | 14 | 53 | 62 | 51 | 44 | 34 |

The temperature of the pressure roller (Comparative Example 1) of balloon rubber reached 230° C. after 14 sheets and the surface thereof was melted and destroyed at 287° C. after 34 sheets. The temperature of the pressure roller of solid rubber (Comparative Example 2) reached 230° C. after 53 sheets and was raised to 244.6° C. at the completion of feeding 75 sheets. As can be understood, in the inventive example using balloon rubber for the first elastic layer, as the thickness of the first elastic layer 116A is thinner, the temperature rise at the non-paper-passing part is alleviated. Since heat transfer proceeds according to a diffusion equation, as the thickness is reduced, the effect of reducing the temperature rise at the non-paper-passing part is more notably exhibited. In particular, as the printing speed increases, a thermal load at the non-paper-passing part increases, and therefore the effect of reducing the temperature rise at the non-paper-passing part increases is desirably increased. In a prototype (Example 1-1) with the first elastic layer 116A having a thickness of 50 μm, a slightly better test result was obtained for the temperature rise at the non-paper-passing part than the pressure roller of solid rubber. This might be attributable to a better heat removal effect due to heat radiation as compared to the case of solid rubber, but still the result could include a measurement error. However, it was confirmed from the experiments that the effect of reducing the temperature rise at the non-paper-passing part was obtained by using the first elastic layer of balloon rubber with a reduced thickness.

Note that the comparison tests were conducted about open-cell foam and closed-cell foam balloon rubber for the first elastic layer, but no significant difference was observed in the test result, and therefore the result is not given herein.

Comparison of Gloss Unevenness

As the thickness of the first elastic layer 116A has been more reduced to cope with higher printing speed, a problem associated with images, gloss unevenness in glossy paper was encountered. This is probably caused by use of closed-cell foam rubber in the balloon rubber of the first elastic layer 116A.

As the heating unit is thermally expanded as the temperature rises, the expansion coefficient of the air is higher than that of silicone rubber. When holes are provided in silicone rubber in order to reduce the layer thickness and secure insulation, the hole part expands especially widely in the case of closed-cell foam. The thermal expansion unevenness gives rise to a problem in images in the form of gloss unevenness when a solid image is printed on glossy paper.

The proposed example uses open-cell foam balloon rubber for the first elastic layer 116A in order to solve the problem. Holes each expand as the heating temperature rises but expanded air can move through adjacent holes in the open-cell foam, and localized expansion can be reduced. This reduces the thermal expansion unevenness, so that gloss unevenness can be reduced.

Comparison tests were conducted to confirm the effect of the inventive example. Two kinds of first elastic layers of a closed-cell foam according to a comparative example and an open-cell foam according to an inventive example were produced with thickness variations, the produced pressure rollers were assembled to identical image forming apparatuses, printing was carried out, and gloss unevenness was compared and evaluated.

A full-page solid image was printed using 130 g of Presentation Paper, glossy paper manufactured by Hewlett-Packard Company, and visual evaluation was conducted. As for gloss unevenness levels, there are four evaluation levels, i.e., ◎ (double circle) represents a good level with no gloss unevenness, O represents a level with substantially no gloss unevenness, A represents a limit level for visually detecting gloss unevenness, and X represents a level with easily detectable gloss unevenness. The evaluation result is given in Table 3.

Result of Gloss Unevenness Comparison Tests

TABLE 3

| | 50 μm | 100 μm | 300 μm | 500 μm |
|---|---|---|---|---|
| Comparative example (closed-cell foam) | X | X | X | Δ |
| Proposed example (open-cell foam) | ○ | ◎ | ◎ | ◎ |

As can be understood, with the pressure roller using closed-cell foam balloon rubber according to the comparative example, gloss unevenness was found here and there, while with the open-cell foam balloon rubber according to the inventive example, gloss unevenness was reduced on the whole. In a conventional closed-cell foam, gloss unevenness tends to be noticeable especially when the first elastic layer has a thinner thickness, and this is probably because the ratio of the hole part relative to the thickness of the layer is large, and the influence of thermal expansion of the hole part in the closed-cell foam is more significant. As can be seen from the test result in the inventive example, use of open-cell foam balloon rubber restrains thermal expansion of the hole part, so that gloss unevenness can be reduced.

As can be understood from the test result, the rising is quicker when the first elastic layer 116A is thicker, but this can be greatly improved by providing an insulation layer of balloon rubber. As for the temperature rise at the non-paper-passing part, the effect of reducing the temperature rise increases as the thickness of the first elastic layer 116A is reduced, and in consideration of today's increased printing speed, the layer must be thinner than 1000 μm, which would be considered sufficient in conventional cases, in order to achieve significant specification improvement though value settings depend on the specification intended by each product. Gloss unevenness is a noticeable disadvantage for conventional closed-cell foam balloon rubber as the first elastic layer is thinned, but use of open-cell foam balloon rubber allows good images to be output even with a reduced layer thickness.

Therefore, in a mode for carrying out the inventive example, it is preferable that the first elastic layer 116A has a thickness of about 500 μm or less, and the lower limit for thickness is 50 μm which is a manufacturing limit by a material property.

Example 2

Now, Example 2 of the present invention will be described.

In Example 2, a thin elastic layer having a thickness of 500 μm or less is stably formed using a liquid composition with low viscosity in forming the first elastic layer 116A, a high thermal conductive acicular filler is mixed in orientation as an anisotropic thermal conductive filler in the second elastic layer 116B, so that the temperature rise at the non-paper-passing part is more effectively reduced, and improved printing performance to small-size paper sheets is implemented.

First Elastic Layer

As means for obtaining open-cell voids in hydrogel, gel obtained by swelling, with water, a material which can absorb water and swell may be used.

Examples of such water-absorbing polymer powder include acrylic acid, methacrylic acid, and a polymer of metal salt thereof, a copolymer thereof, and a crosslinking member thereof. An alkali metal salt of polyacrylic acid and a crosslinking member thereof which can provide hydrogel capable of dispersing water well in a liquid composition including addition curable liquid silicone rubber can be particularly preferably used. Examples of such water-absorbing polymers include "Rheogic 250H" (trade name, manufactured by Toagosei Co., Ltd.) and "BEN-GEL W-200U" (trade name, manufactured by Hojun Co., Ltd.).

The hydrogel is mixed with a material for forming an elastic layer and stirred to prepare an emulsion type liquid composition, and the composition is injected in a cast molding mold and has the base polymer cured, so that rubber having water dispersed homogeneously and finely can be formed. Then, water is evaporated from the rubber, and an elastic layer having fine voids uniformly formed therein can be formed.

When the base polymer is cured and the liquid composition is for example in contact with the air, water in the hydrogel gradually evaporates in a location in contact with the air, and a skin layer with no voids therein forms on the surface of the formed elastic layer. Therefore, in this example, the base polymer was cured while the liquid composition was sealed in a mold in order to prevent the skin layer from forming.

Method for Producing First Elastic Layer

In this example, the following materials were used as the liquid composition for forming the first elastic layer.

The composition included, as main constituents, non-crosslinked addition curable liquid silicone rubber and sodium polyacrylate into which 99 parts by mass of ion exchanged water is added to 1 part by mass of a thickener containing a smectite-based clay mineral (trade name: BEN-GEL W-200U manufactured by Hojun Co., Ltd.), followed by sufficient stirring, and hydrogel was prepared by making the mixture swell. 50% by volume of the hydrogel with reference to the addition curable liquid silicone rubber was added, followed by stirring for 30 minutes at a stirring blade rotation speed of 80 rpm using a universal mixing agitator (trade name: T. K. HIVIS MIX 2P-1 manufactured by Primix Corporation), and a liquid composition for forming the first elastic layer in an emulsion state was obtained.

Other than the above, the roller according to the example was produced by the method described in connection with Example 1 except that the mold wad sealed and heating was carried out at 90° C. for one hour in the step of heating and curing the first elastic layer.

Second Elastic Layer

The second elastic layer 116B is made of solid rubber containing an acicular filler. The acicular filler having high thermal conductivity is formed by making the filler flow in the longitudinal direction of a cast molding mold for example, so that the filler is oriented substantially in the longitudinal direction and therefore high thermal conduction is allowed in the longitudinal direction, so that heat staying in the pressure roller 110 as the temperature rises at the non-paper-passing part during printing can be soaked in the longitudinal direction of the second elastic layer 116B, and the temperature rise at the non-paper-passing part can be restrained.

The longitudinal thermal conductivity of the second elastic layer 116B is preferably at least 2.5 w/(m·K). In this way, the temperature rise in the non-paper-passing region can be restrained sufficiently during high speed printing.

Figure 5A:
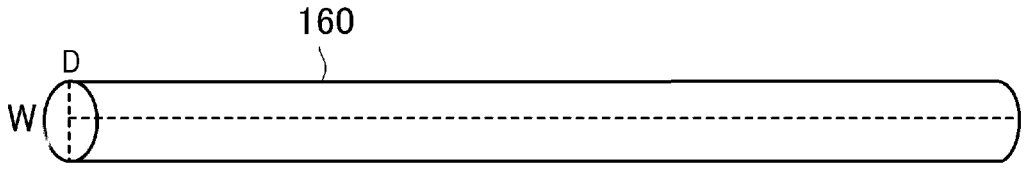
FIG. 5A is a perspective view of an acicular filler according to Example 2 of the present invention.

FIG. 5A is an enlarged perspective view of the acicular filler 160 present in the second elastic layer 116B as an anisotropic thermal conductive filler oriented in the longitudinal direction of the mandrel 117 and having a diameter D and a length L. Note that physical properties of the acicular filler 160 will be described later.

Figure 5B:
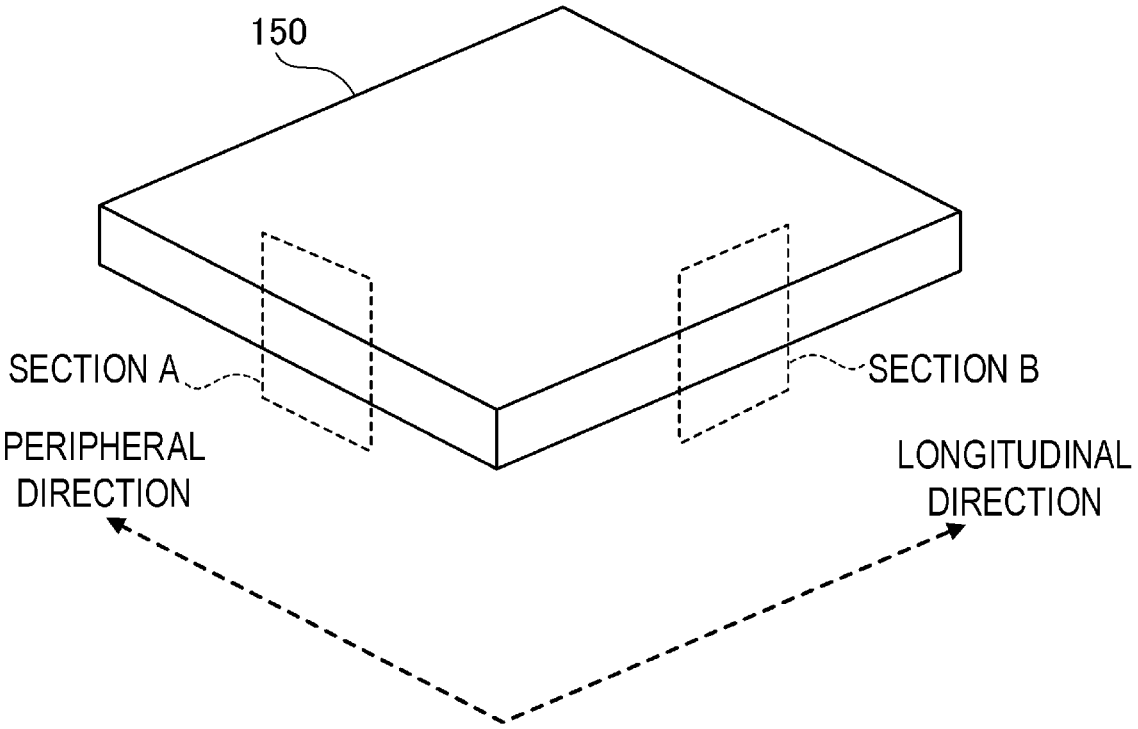
FIG. 5B is a view for illustrating a section of a sample according to Example 2.

FIG. 5B is an enlarged perspective view of a sample 150 cut from the second elastic layer 116B in FIGS. 1A and 1B. The cut sample 150 is cut in the longitudinal and circumferential directions.

Figure 6A:
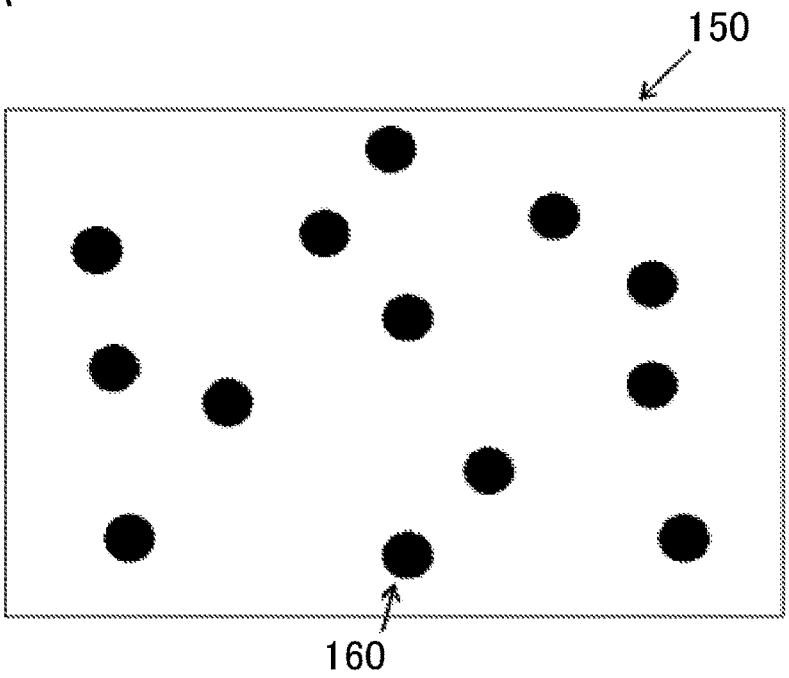
FIGS. 6A and 6B are schematic views of the section of the sample shown in FIG. 5A.
Figure 6B:
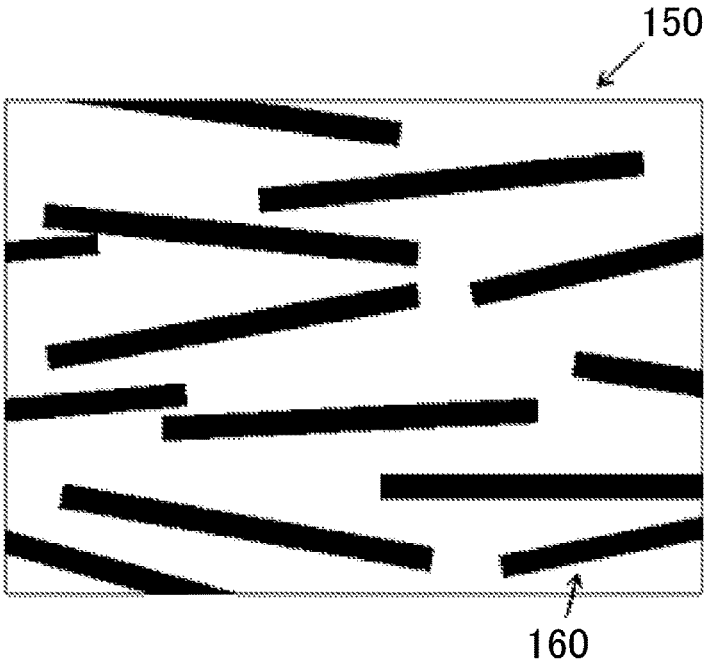

FIG. 6A is an enlarged view of a section (section a) of the cut sample 150 in the circumferential direction, and FIG. 6B is an enlarged view of a section (section b) of the cut sample 150 in the longitudinal direction. As shown in FIG. 6A, a section along the diameter D of the acicular filler 160 is mainly observed in the circumferential section (section a), while as shown in FIG. 6B, the part of the acicular filler 160 along the length W is mainly observed in the longitudinal section (section b). The acicular filler 160 oriented in the direction along the rotation axis of the pressure roller 110 serves as a heat conduction path, and the thermal conductivity in the longitudinal direction along the rotation axis can be increased.

The content of the acicular filler 160 in the second elastic layer 116B is preferably at least 5% by volume with respect to the second elastic layer 116B. The longitudinal thermal conductivity of the pressure roller 110 can be even more increased by setting the content of the acicular filler to at least 5% by volume, and the effect of reducing the temperature rise at the non-paper-passing part can be enhanced.

The content of the acicular filler 160 in the second elastic layer 116B is preferably not more than 40% by volume. The molding can be easily achieved by setting the content of the acicular filler 160 to not more than 40% by volume. Also, the elasticity of the elastic layer can be prevented from being excessively reduced.

A material which allows the ratio of the length W to the diameter D in the acicular filler 160 to be large, in other words, a material with a high aspect ratio is preferably used.

The acicular filler 160 having a thermal conductivity λ of at least 500 W/(m·K) and not more than 900 W/(m·K) is preferably used because the filler can more effectively restrain the temperature rise at the non-paper-passing part.

A specific example of the material is a pitch-based carbon fiber. More specifically, an example of the acicular pitch-based carbon fiber has a diameter D (the average diameter) in the range from 5 μm to 11 μm and a length W (the average length) of about at least 50 μm and not more than 1000 μm as shown in FIG. 5B and is industrially easily available.

Note that the content, the average length, and the thermal conductivity of the acicular filler 160 can be obtained as follows.

As a method for measuring the content (% by volume) of the acicular filler 160 in the elastic layer, a sample is cut from the elastic layer, and the volume thereof at 25° C. is measured using a liquid specific gravity measurement device (SGM-6, manufactured by Mettler-Toledo International Inc.) (Hereinafter, the volume will be referred to as Vall).

Then, evaluation samples after the volume measurement are heated at 700° C. for one hour under a nitrogen gas atmosphere to be decomposed and removed of a silicone rubber component thereof using a thermogravimetric device (trade name: TGA851e/SDTA manufactured by Mettler-Toledo International Inc.). If an inorganic filler is included in the elastic layer other than the acicular filler, the residue after the decomposition and removal has a mixture of the acicular filler and the inorganic filler. The volume Va at 25° C. in this state is measured using a dry automatic densimeter (trade name: Acupic 1330-1, manufactured by Shimadzu Corporation).

The acicular filler is thermally decomposed and removed by heating at 700° C. for one hour under an air atmosphere. The volume Vb of the remaining inorganic filler at 25° C. is measured using a dry automatic densimeter (trade name: Acupic 1330-1, manufactured by Shimadzu Corporation). The weight of the acicular filler can be obtained on the basis of these values from the following expression (5).

$$\text{Content of acicular filler (\% by volume)}=\{(Va-Vb)/Vall\}\times 100 \quad (5)$$

Note that the average length of the acicular filler is obtained by measuring the lengths of at least 1500 randomly selected pieces of the acicular filler using an optical microscope and obtained as the arithmetic mean of the obtained values.

Note that the arithmetic mean about the acicular filler 160 in the second elastic layer 116B can be obtained by the following method. More specifically, a sample cut from the elastic layer is baked at 700° C. for one hour in a nitrogen gas atmosphere and has its silicone rubber component incinerated and removed. In this way, the acicular filler in the sample can be taken out. Then, at least 100 pieces of the acicular filler are randomly selected and measured for their lengths using the optical microscope, and the arithmetic mean of the values is obtained.

The thermal conductivity of the acicular filler 160 can be obtained from the following expression (6) on the basis of a thermal diffusivity obtained using a laser flash method thermal constant measuring system (trade name: TC-7000, manufactured by Ulvac-Riko, Inc.), a specific heat at a constant pressure obtained using a differential scanning calorimeter (trade name: DSC823e, manufactured by Mettler-Toledo International Inc.), and a density obtained using a dry automatic densimeter (trade name: Acupic 1330-1, manufactured by Shimadzu Corporation).

$$\text{Thermal conductivity}=\text{thermal diffusivity}\times\text{specific heat at constant pressure}\times\text{density} \quad (6)$$

Method for Producing Second Elastic Layer

The following six kinds of pitch-based carbon fiber were prepared as the acicular filler 160.

Trade name: XN-100-05M (manufactured by Nippon Graphite Fiber Corporation)

Average fiber diameter: 9 μm

Average fiber length L: 50 μm

Thermal conductivity: 900 W/(m·K)

The acicular filler will hereinafter be referred to as "100-05M."

Trade name: XN-100-15M (manufactured by Nippon Graphite Fiber Corporation)

Average fiber diameter: 9 μm

Average fiber length L: 150 μm

Thermal conductivity: 900 W/(m·K)

The acicular filler will hereinafter be referred to as "100-15M."

Trade name: XN-100-25M (manufactured by Nippon Graphite Fiber Corporation)

Average fiber diameter: 9 μm

Average fiber length L: 250 μm

Thermal conductivity: 900 W/(m·K)

The acicular filler will hereinafter be referred to as "100-25M."

Trade name: XN-100-01Z (manufactured by Nippon Graphite Fiber Corporation)

Average fiber diameter: 9 μm

Average fiber length L: 1000 μm

Thermal conductivity: 900 W/(m·K)

The acicular filler will hereinafter be referred to as "100-01."

Trade name: HC-600-10M (manufactured by Nippon Graphite Fiber Corporation)

Average fiber diameter: 9 μm

Average fiber length L: 100 μm

Thermal conductivity: 600 W/(m·K)

The acicular filler will hereinafter be referred to as "600-10M."

Trade name: HC-600-15M (manufactured by Nippon Graphite Fiber Corporation)

Average fiber diameter: 9 μm

Average fiber length L: 150 μm

Thermal conductivity: 600 W/(m·K)

The acicular filler will hereinafter be referred to as "600-15M."

In the inventive example, the pressure rollers 110 were obtained similarly to Example 1 except that the acicular filler HC-600-15M was used.

The open-cell foam ratio of the first elastic layer was 98%. The thickness-wise thermal conductivity of the first elastic layer 116A was 0.10 W/m·K. The thickness-wise thermal conductivity of the second elastic layer 116B was 1.00 W/m·K. The longitudinal thermal conductivity of the second elastic layer 116B was 15.00 W/m·K.

In the inventive example, the thickness of the first elastic layer of the pressure roller having open-cell voids by hydrogel was varied among 50 μm, 100 μm, 200 μm, 300 μm, and 500 μm, and the pressure rollers were produced using molds having different inner diameters according to respective desired first elastic layers so that the total thickness of the first and second elastic layers was 3.5 mm when the roller outer diameter was ϕ20 mm.

The pressure rollers 110 having the first elastic layers 116A having the respective thicknesses were each measured for the open-cell foam ratio of the first elastic layer 116A, the thickness-wise thermal conductivity of the first elastic layer 116A, the thickness-wise thermal conductivity of the second elastic layer 116B, and the longitudinal thermal conductivity of the second elastic layer 116B, and the result indicated no significant difference. Therefore, the result is not given herein.

Advantageous Effect of Example 2

In order to confirm the advantageous effect of Example 2, the first elastic layer 116A was formed while its thickness was varied using a low viscosity liquid composition, and the pressure roller 110 including the second elastic layer 116B having the high thermal conductive acicular filler 160 mixed in orientation was produced and evaluated.

The first elastic layer 116A was produced stably when the thickness was reduced by using the low-viscosity liquid composition, which provided improved mass-productivity as a result. The result of confirming the advantageous effect carried out about the rising and gloss unevenness in the same procedure as that of Example 1 is given in Table 4.

Rising and Gloss Unevenness Evaluation Result with Addition of Acicular Filler to Second Elastic Layer

TABLE 4

| | Comparative example 1 | Comparative example 2 | Example 2-1 | Example 2-2 | Example 2-3 | Example 2-4 | Exmple 2-5 |
|---|---|---|---|---|---|---|---|
| Balloon rubber | 3500 μm | — | 50 μm | 100 μm | 200 μm | 300 μm | 500 μm |
| Solid rubber | — | 3500 μm | 3450 μm | 3400 μm | 3300 μm | 3200 μm | 3000 μm |
| Filler | — | — | Acicular | Acicular | Acicular | Acicular | Acicular |
| Four-second temperature[° C.] | 196.9 | 168.9 | 172.0 | 181.3 | 183.6 | 186.8 | 191.1 |
| Attaining ratio[%] | 100.0% | 85.8% | 87.4% | 92.1% | 93.2% | 95.1% | 97.0% |
| Gloss unevenness | — | — | ○ | ◎ | ◎ | ◎ | ◎ |

It has been confirmed that Example 2 is useful about the rising and gloss unevenness. The rising tends to be slightly delayed as compared to Example 1 when the thickness of the first elastic layer 116A is thin, but it is probably because the second elastic layer 116B becomes high thermal conductive by the addition of the acicular filler.

In addition to the result in the table, many rollers were produced while the thickness of the first elastic layer 116A was varied, and use of a low viscosity liquid composition allowed safety and yield in the manufacture to be improved. The thickness of 50 μm or more is a limit according to a manufacturing limit depending on the material property.

Figure 7:
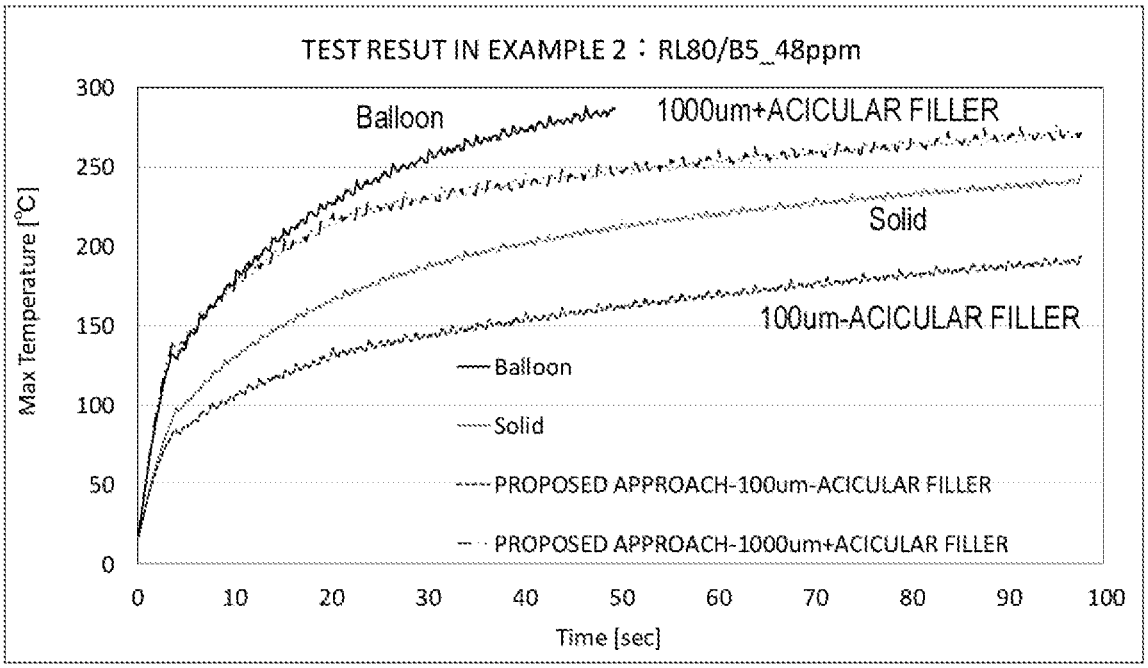
FIG. 7 is a view showing an experiment result according to Example 2.

Then, comparison and evaluation was carried out in the same procedure as that in Example 1 in relation to the effect of reducing the temperature rise at the non-paper-passing part. The test result is given in Table 5 and a typical example of the test result is given in FIG. 7.

Result of Comparison about Temperature Rise at Non-paper Feeding Part with Addition of Acicular Filler to Second Elastic Layer.

TABLE 5

| | Comparative example 1 | Comparative example 2 | Example 2-1 | Example 2-2 | Example 2-3 | Example 2-4 | Exmple 2-5 |
|---|---|---|---|---|---|---|---|
| Balloon rubber | 3500 μm | — | 50 μm | 100 μm | 200 μm | 300 μm | 500 μm |
| Solid rubber | — | 3500 μm | 3450 μm | 3400 μm | 3300 μm | 3200 μm | 3000 μm |
| Filler | — | — | Acicular | Acicular | Acicular | Acicular | Acicular |
| Maximum temperature[° C.] | 318.1 | 244.6 | 179.6 | 194.2 | 203.3 | 218.5 | 236.9 |
| Number of sheets until attaining 230° C. | 14 | 53 | 75 or more | 75 or more | 75 or more | 75 or more | 65 |

It has been confirmed by the experiments that addition of the acicular filler 160 allows the effect of soaking to be higher than conventional solid rubber (Comparative Example 2), and the temperature rise at the non-paper-passing part is significantly reduced as compared to Example 1.

The temperature rose to 230° C. at the non-paper-passing part for the 14th sheet using the balloon rubber in Comparative Example 1 and for the 53rd sheet using solid rubber in Comparative Example 2, while in Example 2 in which the acicular filler 160 is arranged in orientation in the second elastic layer 116B, the temperature rise at the non-paper-passing part was lower than the conventional solid rubber as the thickness of the first elastic layer 116A increased to about 500 μm, and at least 75 sheets can be fed.

This is because local temperature unevenness generated in the longitudinal direction is moved/smoothed by the acicular filler 160. Therefore, the temperature rise at the non-paper feeding part can be restrained more effectively by adding the acicular filler 160 as an anisotropic thermal conductive filler in thermal transport capability to the second elastic layer 116B, and therefore the printing performance can further be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-143886, filed on Jul. 25, 2017, which is hereby incorporated by reference herein in its entirety.

What is claimed is:

1. A pressure roller comprising:
a mandrel;
a first elastic layer; and
a second elastic layer provided between the mandrel and the first elastic layer,
wherein the pressure roller is suitable for use in an image heating device which heats a toner image borne on a recording material,
wherein the first elastic layer is made of rubber having open-cell voids, and the second elastic layer is made of solid rubber,
wherein a thickness-wise thermal conductivity λ1 of the first elastic layer is 0.06 W/(m·K) to 0.16 W/(m·K), and a thickness-wise thermal conductivity λ2 of the second elastic layer is 0.2 W/(m·K) to 2.0 W/(m·K), and
wherein the first elastic layer has a thickness of 50 μm to 500 μm.

2. The pressure roller according to claim 1, wherein the second elastic layer includes a high thermal conductive filler.

3. The pressure roller according to claim 1, wherein the second elastic layer includes an anisotropic thermal conductive filler.

4. The pressure roller according to claim 1, wherein the first elastic layer has an open-cell foam ratio of 70% to 100%.

5. An image heating device, comprising:
the pressure roller of claim 1; and
a heating rotary member which forms a nip part together with the pressure roller,
wherein a toner image borne on a recording material is heated while the recording material is transported at the nip part.

6. The image heating device according to claim 5, wherein the heating rotary member includes a cylindrical film.

7. The image heating device according to claim 6, further comprising a heating member provided in contact with an inner surface of the film,
wherein the film is pressed against the heating member by the pressure roller to form the nip part.

8. An image forming apparatus, comprising:
an image forming unit which forms a toner image on a recording material; and
the image heating device of claim 5.

9. The pressure roller according to claim 2, wherein the high thermal conductive filler includes at least one of alumina, zinc oxide, silicon carbide, and graphite.

10. The pressure roller according to claim 9, wherein a content of the high thermal conductive filler is 1% by volume to 60% by volume.

11. The pressure roller according to claim 3, wherein the anisotropic thermal conductive filler includes a pitch-based carbon fiber.

12. The pressure roller according to claim 11, wherein a content of the anisotropic thermal conductive filler is not more than 40% by volume.

13. The pressure roller according to claim 1, wherein a porosity of the first elastic layer is 20% by volume to 70% by volume.

14. The pressure roller according to claim 1, wherein a thickness t1 of the first elastic layer is smaller than a thickness t2 of the second elastic layer.

15. A pressure roller comprising:
a mandrel;
a first elastic layer; and
a second elastic layer provided between the mandrel and the first elastic layer,
wherein the pressure roller is suitable for use in an image heating device which heats a toner image borne on a recording material,
wherein a thickness-wise thermal conductivity λ1 of the first elastic layer is 0.06 W/(m·K) to 0.16 W/(m·K), and a thickness-wise thermal conductivity λ2 of the second elastic layer is 0.2 W/(m·K) to 2.0 W/(m·K), and
wherein the first elastic layer has a thickness of 50 μm to 500 μm.

* * * * *